United States Patent [19]

Miller

[11] Patent Number: 5,028,052

[45] Date of Patent: Jul. 2, 1991

[54] GOLF MAT

[76] Inventor: Omer E. Miller, 416 Wildwood Dunes Trail, Myrtle Beach, S.C. 29577

[21] Appl. No.: 522,377

[22] Filed: May 11, 1990

[51] Int. Cl.[5] ..... A63B 69/36

[52] U.S. Cl. ..... 273/195 R; 273/176 H; 273/DIG. 31; 273/195 A

[58] Field of Search ..... 273/195 R, 195 A, 195 b, 273/176 H, DIG. 31; 15/217

[56] References Cited

U.S. PATENT DOCUMENTS

| | | | |
|---|---|---|---|
| 957,387 | 5/1910 | Stedman | 273/178 B |
| 1,983,671 | 12/1934 | Kohler | 273/195 R |
| 2,124,123 | 7/1938 | Rosengarten | 273/195 A |
| 2,790,640 | 4/1957 | Hoag | 273/195 A |
| 2,941,808 | 6/1960 | Smith et al. | 273/195 R |
| 3,143,350 | 8/1964 | Lester | 273/195 A |
| 3,348,847 | 10/1967 | Fischl | 273/195 R |
| 3,423,096 | 1/1969 | Tone | 273/195 A |
| 3,542,369 | 11/1970 | Anderson | 273/195 R |
| 3,599,982 | 8/1971 | Elesh | 273/175 |
| 3,639,923 | 2/1972 | Stewart | 273/195 A |
| 3,869,128 | 7/1974 | Ohashi | 273/195 A |
| 4,092,027 | 9/1976 | Carter | 273/195 R |
| 4,387,896 | 6/1983 | O'Brien | 273/195 A |
| 4,844,470 | 7/1989 | Hammon | 273/195 A |

FOREIGN PATENT DOCUMENTS

| | | | |
|---|---|---|---|
| 0661248 | 4/1963 | Canada | 273/195 A |
| 0962711 | 2/1975 | Canada | 273/195 R |
| 0286620 | 12/1988 | European Pat. Off. | 273/195 R |
| 2068740 | 8/1981 | United Kingdom | 273/195 R |
| 2107593 | 5/1983 | United Kingdom | 273/195 R |

*Primary Examiner*—Edward M. Coven
*Assistant Examiner*—Steven Wong
*Attorney, Agent, or Firm*—Bacon & Thomas

[57] ABSTRACT

A golf mat for practicing golf shots is disclosed that accurately simulates the feel of natural turf, while at the same time has no moving portions and is readily transported by the golfer. The device has a base member formed of a resilient plastic material, such as polycarbonate, that is supported by multiple feet formed of a resilient foam material. A layer of tufted material defining a golf ball hitting surface, which may be greige goods material having a non-hardening elastomeric adhesive secondary backing, is attached to an upper side of the base member at discrete, spaced apart areas. The tufted layer, which may be attached to the base member by adhesive bonding, is attached to the generally rectangular base member only at areas adjacent to the corners of the base member. The tufted layer should be attached to the base member at the minimum number of points to improve the simulation of natural turf. Layers of friction reducing material, such as polyethylene plastic, are interposed between the tufted layer and the base member to minimize the shear forces between these elements when the golf mat is stuck by the golf club head.

15 Claims, 2 Drawing Sheets

FIG. 2
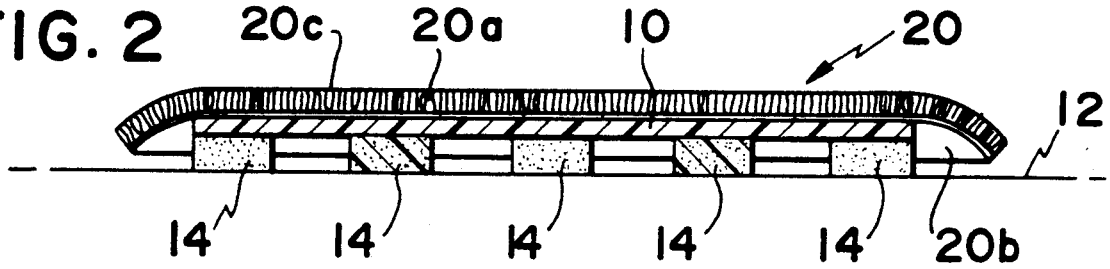
FIG. 3
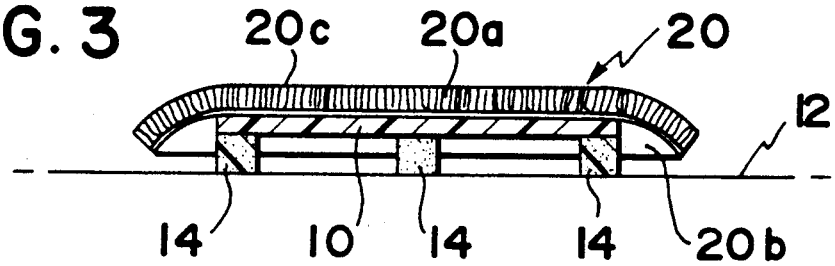
FIG. 4
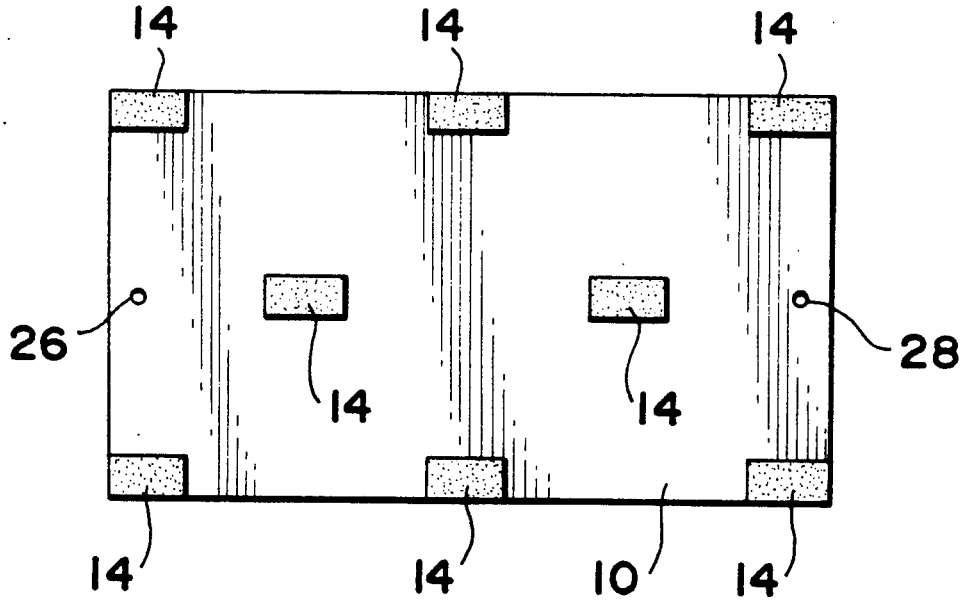
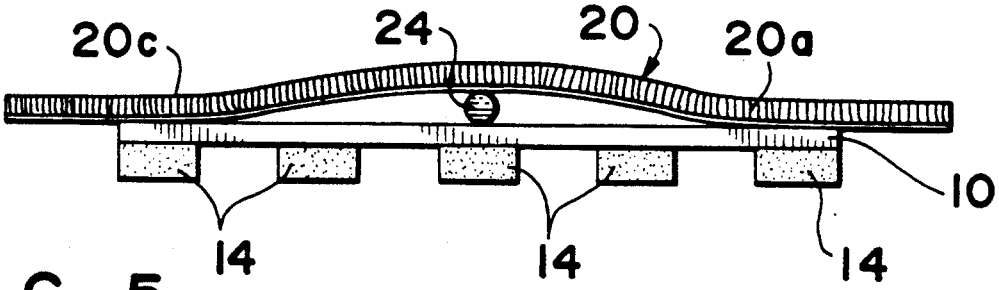
FIG. 5

GOLF MAT

BACKGROUND OF THE INVENTION

The present invention relates to a golf mat presenting a golf ball hitting surface that accurately simulates natural turf to the golfer.

Many golf shots require the golfer to swing the golf club such that the head of the club passes through and downwardly of the golf ball position to take a divot out of the ground. The intricacies of the game of golf are such that a golfer is required to put in innumerable hours of practice in order to obtain a desired level of proficiency and to maintain this level. The practicing of fairway golf shots requiring the golfer to swing the club head down and through the ball has proven exceedingly difficult and time consuming due to the limited number of natural turf areas upon which the golfer may practice and the continuing need to replace the divots taken out during practice.

In view of the limited availability of such natural turf practice areas, many artificial turf devices have been developed over the years in an attempt to accurately simulate the feel of natural turf to the golfer. Many of these artificial turf devices have portions that are movable along the path of travel of the club head and incorporate springs, rubber bands, or the like to return the movable portion to its initial position. Other devices have used movable belts with artificial turf surfaces movable in a direction along the path of travel of the club head. While these devices have achieved a modicum of success, they have proven to be too complex to be marketed at a reasonable price and either non-portable or too cumbersome for the golfer to readily transport the device.

Golf practice mats are also known which comprise an artificial turf surface bonded to a base formed of foam rubber or other deformable material. While these devices are less complex than those having the movable portions and are easily transported by the golfer, they have not proven totally successful insofar as they do not accurately simulate the feel of natural turf to the golfer.

SUMMARY OF THE INVENTION

The present invention relates to a golf mat for practicing golf shots that accurately simulates the feel of natural turf, while at the same time has no moving portions and is readily transported by the golfer.

The device has a base member formed of a resilient plastic material, such as polycarbonate, that is supported by multiple feet formed of a resilient foam material. A layer of tufted material defining a golf ball hitting surface, which may be a greige goods material having a non-hardening elastomeric adhesive backing, is attached to an upper side of the base member at discrete, spaced apart areas. The tufted layer, which may be attached to the base member by adhesive bonding, is attached to the generally rectangular base member only at areas adjacent to the corners of the base member. The tufted layer should be attached to the base member at the minimum number of points to improve the simulation of natural turf.

Layers of friction reducing material, such as polyethylene plastic, are interposed between the tufted layer and the base member to minimize the shear forces between these elements when the golf mat is struck by the golf club head. The length and width of the tufted layer may be greater than those of the base member such that edge portions of the tufted layer will overhang the base member and provide a ramp to enable the golfer to push golf balls up onto the hitting surface.

A spacer rod may be inserted under the tufted layer near its center before it is attached to the base member in order to provide a certain amount of "play" between the tufted layer and the base member. Following the adhesive bonding of the tufted layer to the base member, the spacer rod is removed.

The base member may be a relatively thin plastic (on the order of 0.030 inches to 0.060 inches) thereby rendering the entire assembly light weight and easily transportable. The golf mat according to the invention may be readily rolled up and carried in the golfer's bag.

Since the base member and the assembly is generally planar in configuration, it requires no specific hitting direction by the golfer. Thus, different hitting directions may be used to more evenly distribute the wear on the carpet layer.

BRIEF DESCRIPTION OF THE DRAWINGS

FIG. 2 is a longitudinal cross-sectional view of the golf mat shown in FIG. 1.

FIG. 3 is a transverse cross-sectional view of the golf mat shown in FIGS. 1 and 2.

FIG. 4 is a bottom view of the golf mat shown in FIG. 1 illustrating the positions of the foam supporting feet.

FIG. 5 is a side view of the golf mat according to the invention during the assembly of the carpet layer to the base member illustrating the presence of the spacer rod.

DETAILED DESCRIPTION OF THE PREFERRED EMBODIMENT

Figure 1:
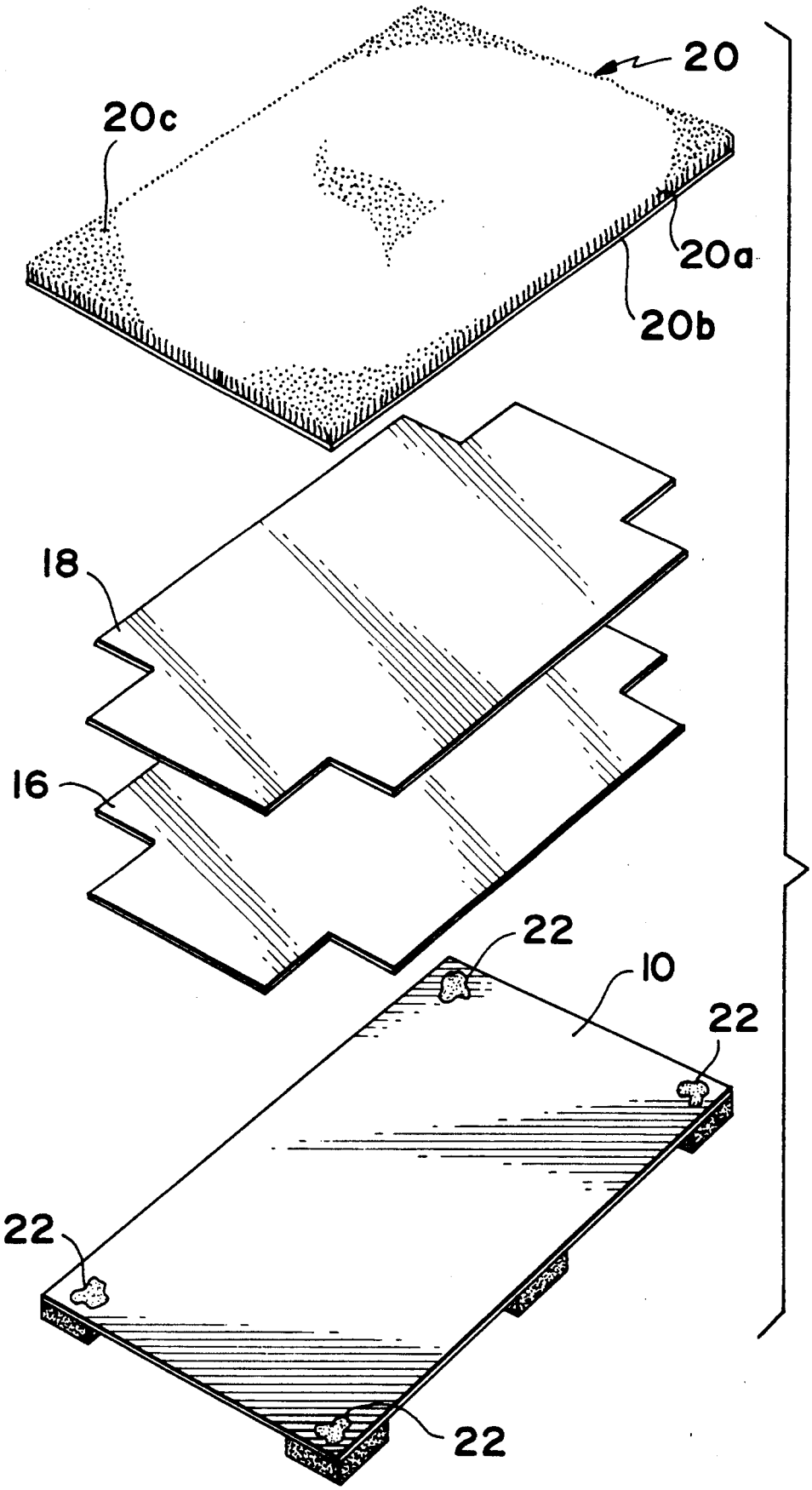
FIG. 1 is an exploded perspective view of the golf practice mat according to the invention.

As best illustrated in FIG. 1, the golf practice mat according to the invention comprises a base member 10 formed of a resilient plastic material, such as polycarbonate sold under the trade name Lexan. The material from which the base member 10 is formed is self supporting, but will resiliently deform if a load is placed thereon. As illustrated, the base member 10 is generally planar and has a generally rectangular shape. Although the invention will be described with the generally rectangular base member, it is to be understood other shapes may be utilized without exceeding the scope of this invention.

The polycarbonate material forming the base member has a thickness on the order of 0.030 inches 0.060 inches. Again, this range of thicknesses has been found to be effective, but other thicknesses of the base member could be utilized without exceeding the scope of this invention.

The base member 10 is supported on a surface 12, as shown in FIGS. 2–4, by a plurality of supporting feet 14. Supporting feet 14 may be formed of a resilient foam material and have dimensions on the order of 1 inch by 1 inch by 2 inches. The supporting feet 14 may be adhesively bonded to base member !0 and are located as illustrated in FIG. 4 with three such supporting feet located along either side of the base member 10 and two supporting feet generally centrally located.

Sheets 16 and 18 of friction reducing material, such as polyethylene plastic, are placed on an upper surface of the base member 10. Sheets 16 and 18 are generally rectangular in shape, but each of the corners have been removed for purposes to be hereinafter described in more detail. Although two separate sheets 16 and 18 have been illustrated, it is to be understood that the sheets or layers of polyethylene may be joined at one or more edge portions.

A layer 20 of tufted material is placed over the polyethylene sheets 16 and 18. The tufted material layer 20 may comprise a layer of greige goods material 20*a* having a secondary non-hardening elastomeric adhesive backing layer 20*b* instead of the normal or outdoor carpet backing. The adhesive 20*b* forms a matrix for the individual tufts and the warp of the primary backing of the greige goods securing all tufts and allowing tufted layer 20 to remain flexible. Tufted layer 20, which defines a golf ball hitting surface 20*c* is adhesively bonded to the base member 10 only at discrete, spaced apart areas near the corners of the rectangular base member. The adhesive is applied to the base member 10 as illustrated at 22 in FIG. 1 and is also applied to the underside of tufted layer 20 at locations corresponding to the corners of base member 10. The adhesiVe areas are located such that they come in direct contact with each other, since the intervening polyethylene layers 16 and 18 have been cut away to allow this direct contact. It has been found that the tufted layer 20 should be attached to the base member 10 at the minimum number of points possible. This minimal adhesive contact, coupled with the polyethylene sheets 16 and 18 being interposed between the tufted layer and base member allows both the tufted layer 20 and base member 10 to flex while the polyethylene sheets minimize the shear forces between the tufted layer 20 and the base member 10.

Prior to assembling the tufted layer 20 to the base member 10, a spacer rod 24 is inserted between these elements as illustrated in FIG. 5. The spacer rod, which may have a 5/16 inch diameter, extends laterally across the central portion of the base member 10 and elevates the central portion of the tufted layer 20 with respect to the base member 10. Once the adhesive attaching the tufted layer 20 and base member 10 has cured and the tufted layer 20 has been affixed to the base member 10, the spacer rod 24 is withdrawn. The polyethylene layers 16 and 18 are held in place between the tufted layer 20 and the base layer 10 by overage from the adhesive 22 applied to the base member 10 and from similar adhesive applied to corresponding points on the bottom of the tufted layer 20.

It has been found that the device constructed according to the invention will impart to the golfer the feel of natural turf as the club head strikes a golf ball placed on hitting surface 20*a*. The flexing of the tufted layer 20, the base member 10 and the foam legs 14 simulates the taking of a divot from natural turf and will, at the same time, minimize any forward or sideways movement imparted to the device by the golf club head.

Although it has been found that very little movement will be imparted to the device by the golf club head, holes 26 and 28 may be provided at either end of the base member 10 in order to facilitate the attachment of a tether or an elastic member to the golf practice mat. The other end of the tether may be fastened in the ground by a golf tee, or may be attached to the golfer's bag to provide a positive means of preventing any forward movement as the device is struck by the golf club head. The sensitivity or "feel" of the golf mat may be varied by using different thicknesses of base member 10. It has been found that a thickness of between 0.030 inches and 0.060 inches provides the most realistic "feel".

The length and width dimensions of the tufted layer 20 are greater than those of the base member 10 such that edge portions of the tufted layer 20 extend beyond the edges of the base member 10, as illustrated best in FIGS. 2 and 3. The edge portions of the tufted layer 20 overhanging the base member 10 droop down towards the support surface 12 and may be used as ramps by the golfer to move a golf ball from the surface 12 up onto the hitting surface 20*a*.

The foregoing description is provided for illustrative purposes only and should not be construed as in any way limiting this invention, the scope of which is defined solely by the appended claims.

What is claimed is:

1. A golf mat comprising:

a) a generally planar base member formed of resilient plastic material and having first and second sides;

b) a plurality of supporting feet attached to the first side of the base member;

c) a layer of tufted material having an elastomeric backing and defining a golf ball hitting surface adhesively bonded to the second side of the base member only at discrete, spaced apart areas; and, d) at least one layer of friction reducing material interposed between the tufted material layer and the base member to reduce the shear forces between the tufted material layer and the base member during the hitting of a golf ball off the hitting surface.

2. The golf mat according to claim- 1 wherein the base member is formed of a polycarbonate plastic material.

3. The golf mat according to claim 2 wherein the thickness of the polycarbonate base member is between 0.030" and 0.060".

4. The golf mat according to claim 1 wherein the base member is generally rectangular in shape and wherein the layer of tufted material is adhesively bonded to the base member only at areas adjacent to the corners of the base member.

5. The golf mat according to claim 1 wherein the layer of tufted material is formed of a greige goods material.

6. The golf mat according to claim 5 wherein the greige goods material has a secondary backing of non-hardening elastomeric adhesive.

7. The golf mat according to claim 6 wherein the base member is formed of a polycarbonate plastic material.

8. The golf mat according to claim 7 wherein the base member is generally rectangular in shape and wherein the layer tufted material is adhesively bonded to the base member only at discrete areas adjacent to the corners of the base member.

9. The golf mat according to claim 1 wherein friction reducing material comprises polyethylene plastic.

10. The golf mat according to claim 9 comprising two layers of polyethylene plastic interposed between the layer of tufted material and the base member.

11. The golf mat according to claim 10 wherein the layer of tufted material is formed of a greige goods material.

12. The golf mat according to claim 11 wherein the greige goods material has a secondary backing of non-hardening elastomeric adhesive.

13. The golf mat according to claim 12 wherein the base member is formed of a polycarbonate plastic material.

14. The golf mat according to claim 13 wherein the base member is generally rectangular in shape and wherein the layer of tufted material is adhesively bonded to the base member only at discrete areas adjacent to the corners of the base member.

15. A golf mat according to claim 14 wherein the supporting feet are formed of a resilient foam material.

* * * * *

UNITED STATES PATENT AND TRADEMARK OFFICE

CERTIFICATE OF CORRECTION

PATENT NO. : 5,028,052

DATED : July 2, 1991

INVENTOR(S) : MILLER

It is certified that error appears in the above-identified patent and that said Letters Patent is hereby corrected as shown below:

In the Abstract, line 21, "stuck" should be --struck--;

Column 2, line 51, after "inches" should be --to--;

Column 3, line 22, "a dhesiVe" should be --adhesive--;

Column 4, line 54, Claim 8, after "layer" should be --of--.

Signed and Sealed this

Ninth Day of February, 1993

*Attest:*

STEPHEN G. KUNIN

*Attesting Officer*

*Acting Commissioner of Patents and Trademarks*